United States Patent [19]

Pfleger

[11] 4,178,732

[45] Dec. 18, 1979

[54] APPARATUS FOR CLOSING AND OPENING THE THREADED NECKS OF CONTAINERS

[76] Inventor: Frederick W. Pfleger, 1152 Barbara Dr., Cherry Hill, N.J. 08034

[21] Appl. No.: 898,825

[22] Filed: Apr. 21, 1978

[51] Int. Cl.[2] ..... B65B 7/28; B67B 3/20

[52] U.S. Cl. ..... 53/309; 53/317; 53/331.5; 53/381 A

[58] Field of Search ..... 53/309, 317, 318, 331.5, 53/381 A, 492; 81/3.2, 3.33, 3.1 B, 3.3 A; 29/240

[56] References Cited

U.S. PATENT DOCUMENTS

| | | | |
|---|---|---|---|
| 2,940,229 | 6/1960 | Baker | 53/331.5 X |
| 3,151,426 | 10/1964 | Pechmann | 53/309 X |
| 3,435,587 | 4/1969 | Weller | 53/331.5 X |
| 4,030,271 | 6/1977 | Kefauver et al. | 53/381 A X |

*Primary Examiner*—Horace M. Culver
*Attorney, Agent, or Firm*—Robert K. Youtie

[57] ABSTRACT

Apparatus wherein a body includes a passageway having one end adapted to receive the neck of a container and the other end in communication with a closure magazine, and a roller mounted in the body generally tangential to the passageway for rolling engagement with a closure, the roller being configured with a reduced region for passing a closure into generally tangential relation, roller rotation in opposite directions serving to tangentially rotate a closure to closed and opened relation upon opposite directional roller rotation, respectively.

13 Claims, 13 Drawing Figures

APPARATUS FOR CLOSING AND OPENING THE THREADED NECKS OF CONTAINERS

BACKGROUND OF THE INVENTION

While the device of the present invention has been primarily developed for use in the capping and uncapping of laboratory vials, and has been permanently developed and employed for this purpose and will be illustrated and described hereinafter with particular reference thereto, it is appreciated that the inventive concepts herein are capable of many varied applications, all of which are intended to be comprehended herein.

The general art of capping and uncapping containers is quite highly developed, examples of the development being disclosed in U.S. Pat. Nos. 4,030,271; 3,852,941; 3,844,093 and 3,522,690. However, the prior art devices are extremely complex, expensive and unreliable, and not suited for use in the manner of applicant's device, except for U.S. Pat. No. 4,030,271. However, this device is relatively costly and lacking in long term reliability.

SUMMARY OF THE INVENTION

It is, therefore, an important object of the present invention to provide a container capping and uncapping apparatus of the type described which overcomes the above mentioned difficulties of the prior art, substantially reducing costs both initially and continuing by reason of an apparatus of simple and inexpensive construction which is durable and reliable throughout a long useful life.

It is a further object of the present invention which is particularly well adapted for laboratory use in that the caps and containers need not be touched by operating personnel or others, in order to maintain requisite sanitary conditions.

It is a further object of the present invention to provide a container capping and uncapping apparatus which is conveniently usable with conventional container holders or boxes, so as to avoid the need for a conveyor and permit handling of the containers in the conventional manner.

It is still a further object of the present invention to provide a container capping and uncapping apparatus having the advantageous characteristics mentioned in the preceding paragraphs, which is extremely simple to operate, so that relatively unskilled persons may, with great rapidity, remove and replace the caps with respect to relatively large numbers of containers.

Other objects of the present invention will become apparent upon reading the following specifications and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
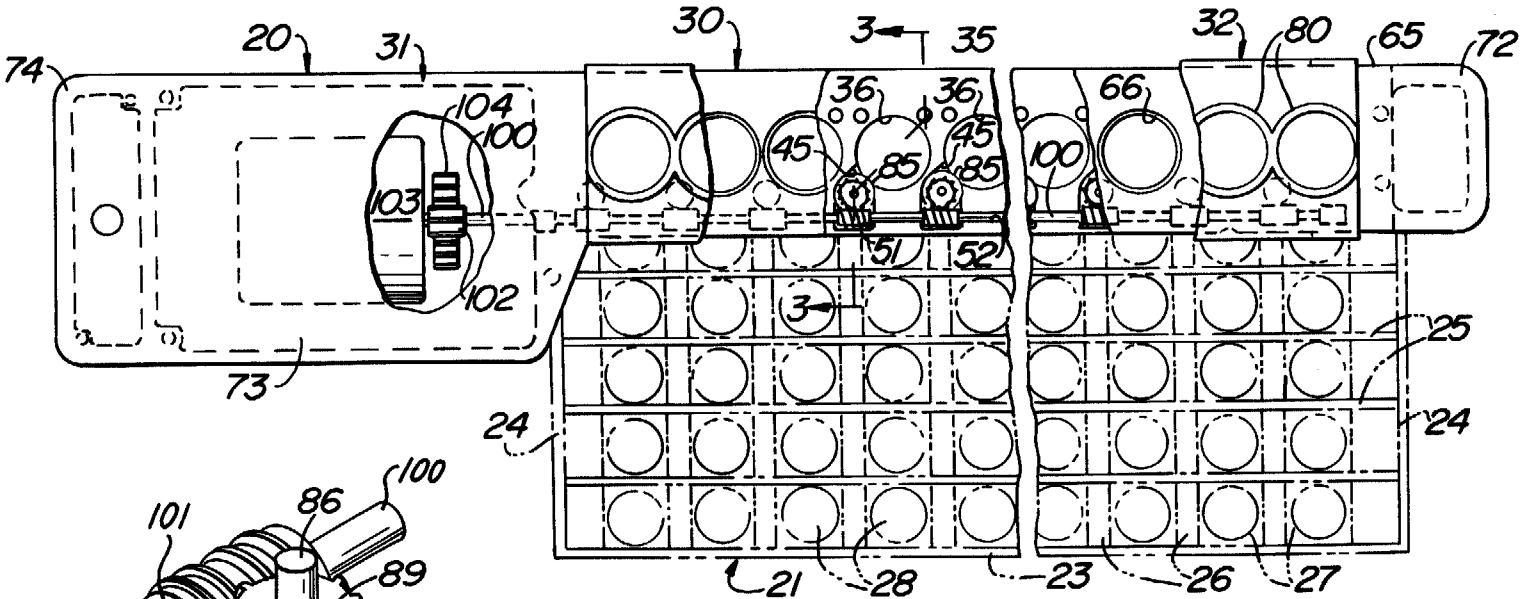
FIG. 1 is a top plan view showing an apparatus of the present invention, partly broken away to illustrate internal construction, and illustrating the apparatus in operative relation with respect to a conventional container holder, the latter being shown in dot-and-dash outline.
Figure 13:
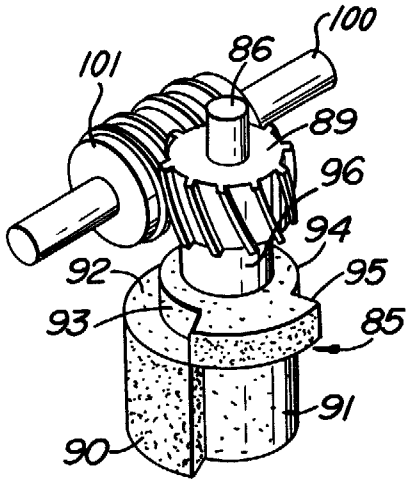
FIG. 13 is a perspective view showing a roller and drive of the present invention apart from the remainder of the apparatus.
Figure 2:
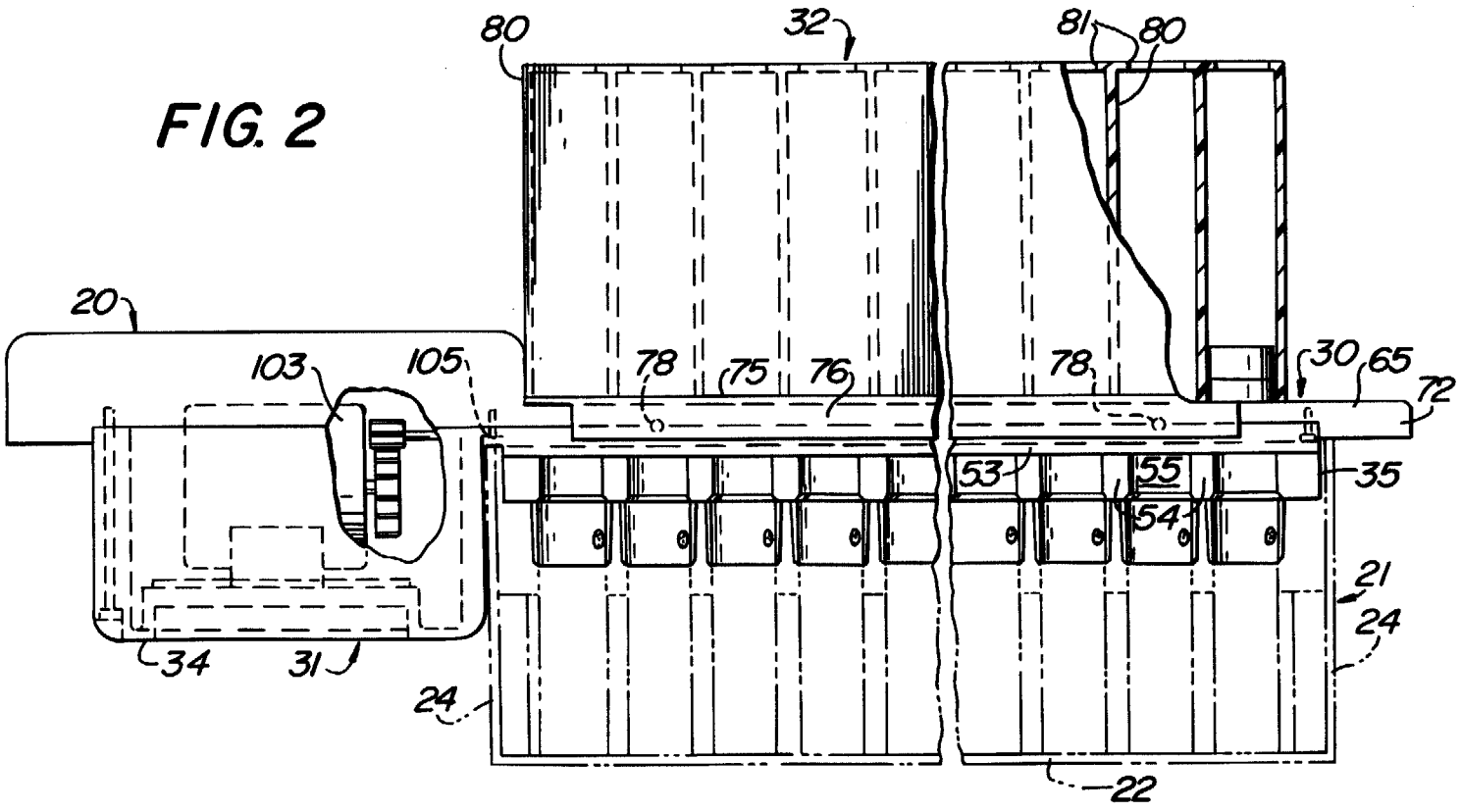
FIG. 2 is a front elevational view of the apparatus of FIG. 1, also partly broken away, and illustrating the container holder or case in phantom.

Referring now more particularly to the drawings, and specifically to FIGS. 1 and 2 thereof, the capping and uncapping device of the present invention is there generally designated 20 and is superposed over a conventional vial holder, case or box 21, including a generally rectangular bottom wall 22, upstanding side walls 23 and end walls 24 upstanding from the sides and ends of bottom wall 22. In addition, the interior of the holder or case 21 may be provided with a grid work of internal separators, including a plurality of longitudinally extending separators or dividers 25, and a plurality of laterally extending separators or dividers 26 intersecting with the longitudinal dividers to define a plurality of longitudinally and transversely extending rows or ranks and files of cells or receivers 27 for respective vials or containers 28.

The device or apparatus 20 may include a longitudinally extending elongate body 30 for location over a row of containers 28 in the holder 21. Extending longitudinally from one end of the body 30 is a motor casing or housing 31, outboard of the holder 21, as seen in FIGS. 1 and 2. A magazine for storing closures or caps is generally designated 32 and shown in position superposed on the body 30 for delivering caps to the body in the capping mode and receiving caps from the body in the uncapping mode.

The body 30 may include an elongate main part 35, from one end of which extends a lower, upwardly opening hollow section 36 of motor housing 31. The main body part 35 may include a plurality of through bores or passageways 36 each extending generally vertically in the operative orientation of FIGS. 1 and 2, and arranged in a side by side aligned relation or row longitudinally of the lower body part 35 sized and spaced for respective reception of containers 28 in the holder 21. The passageways or bores 36 are each internally generally cylindrical, and provided in a lower region with a generally downwardly facing shoulder or abutment 37, as defined by an internal generally conical surface diverging downwardly, see FIG. 3. The lower body part 35 is provided along one longitudinal side with a laterally outstanding, longitudinally extending flange 38 having its upper surface substantially flush with the upper surface 39 of the lower body part and provided on its underside with a longitudinally extending, downwardly facing channel or groove 40, for receiving an upper edge margin of a holder side wall 23.

The lower body part 35, laterally oppositely of the flange 38 is provided with a plurality of generally cylindrical recesses or bores 45 extending downwardly through the upper surface 39 toward the under surface or lower side 46 of the body part 35 and terminating short of the under surface at an internal bottom wall 47. In particular, each recess or cavity 45 is located in generally tangential relation with and opening into a respective adjacent passageway 36. That is, the region 48 of each cavity 45 proximate to its associated passageway 36 may be considered as an opening communicating into the adjacent passageway. The bottom wall 47 of each cavity 45 may be provided with a blind, generally centrally located bore or hole 50, for a bearing, as will appear presently.

Thus, the several generally cylindrical cavities 45 are located in side by side aligned relation with respect to each other, in a row longitudinally of the body 30, and on one side of the body part 35, remote from the flange 38. In addition, the upper surface 39 of the lower part 35 is provided with a plurality of relatively shallow, upwardly opening recesses, as at 51, each opening laterally inwardly into an upper region of a respective adjacent cavity 45. The recesses 51 are also in a row in alignment with each other longitudinally of the body 30. The upper surface 39 of lower body part 35 is further formed with a longitudinally extending upwardly opening groove 52 which extends through and opens into the several aligned recesses 51. Additionally, the lower body part 35 may be provided with a longitudinally extending flange or overhang 53 extending laterally beyond the cavities 45 and into which are formed the recesses 51 and groove 52. Under the overhang 53, the external side surface is recessed, as at 54, and further provided with generally semi-cylindrical, vertically extending and downwardly opening hollows 55. These may be seen in FIG. 2, and serve to receive a row of containers 28 adjacent to the row of containers being operated upon.

Figure 3:
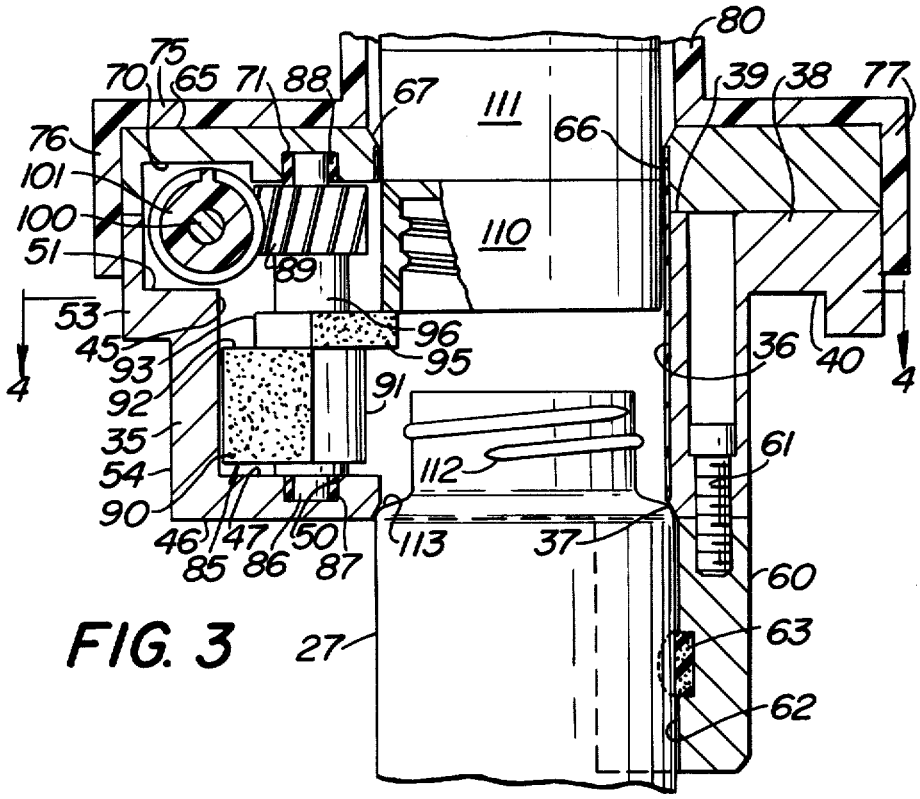
FIG. 3 is a partial transverse sectional elevational view taken generally along the line 3—3 of FIG. 1 illustrating the apparatus in condition prior to the capping of an initial container.

A depending body extension is generally designated 60, each being associated with a respective passageway 36, so that a plurality of such extensions depend from the under surface 46 of body part 35, the several extensions 60 being generally aligned with each other longitudinally of the body 30, each spaced on the opposite side of the respective passageway 36 as its associated recess 45, which may best be seen in FIG. 3. It will there be observed that each depending extension 60 may be removably secured by suitable fastener means, such as a threaded fastener 61. Further, the depending extensions 60 are each formed on one face 62 with a generally semi-cylindrical surface concentric with the axis of passageway 36 and of a radius of curvature slightly greater than that of the passageway. As best seen in FIG. 3, the generally semi-cylindrical surface 62 of extension 60 depends from the downwardly flaring shoulder or conical surface 37, being generally a cylindrical extension of the larger end of conical shoulder 37.

On the internal or semi-cylindrical surface 62 of each extension 60 there is provided a frictional holding member or pad 63, generally diametrically opposed to the recess 45. Also, the interior surface of passageway 36, generally diametrically opposed to the recess 45, may be a relatively smooth, low friction surface, as by the application of Teflon, or otherwise.

A body top plate or cover member 65 rests on the upper surface 39 of body part 35, being elongate to overlie the entire body part 35; and, the top plate 65 is formed with a plurality of through holes 66 arranged in a row for respective locations over and in alignment with the several through passageways 36. Thus, each of the passageways 36 opens upwardly through a respective hole 66 of the top plate 65. The upper ends of the holes 66 may be bevelled or chamfered, as at 67, see FIG. 3. Additionally, the under side of top plate 65 is provided with a recess 70 complementary to and in facing relation with each recess 51, the recesses 70 each including a journal receiving bore 71 in general vertical alignment with a respective lower journal receiving bore 50. Extending from one end of the top plate 65, beyond the body part 35, remote from the motor housing 31, may be a hand grip portion or extension 72. Extending from the other end of the top plate 65 may be a motor casing cover or lid 73 for complementary covering relation with respect to the motor housing receptacle 34; and longitudinally outwardly beyond the motor casing cover 73, there may extend a hand grip or handle portion 74 oppositely with respect to the handle portion 72. The top plate 65 with its motor housing cover 73 may be suitably secured by any desired means in overlying relation with the body part 35.

The magazine 32 may include a base plate or mounting member 75 resting on the upper surface of top plate 65, and having a pair of side flanges 76 and 77 depending from respective side edges of the mounting member 75 for removable snap engagement with the body part 35, as by detents 78. Upstanding from the mounting plate 75, in a row longitudinally therealong, are a plurality of generally cylindrical closure holders 80. The closure holders 80 are each located over and in alignment with a respective hole 76 of the body top plate 65, opening through the mounting plate 75 to communicate with the aligned hole 66 for passing and receiving closures with respect to the latter, as will appear more fully hereinafter. Specifically, each of the cylindrical closure holders 80 may have its internal cylindrical surface of a diameter approximately equal to the larger diameter of the adjacent aligned chamfer or shoulder 67, as best seen in FIG. 3. The other or distal end of each cylindrical holder 80 may be obstructed by a circumferential, inturned or internal flange or lip 81, see FIG. 2.

The magazine 32 is removable from its illustrated assembled relation with the body parts 35 and 65 by suitable outward flexure of the mounting plate side walls 76 and 77 to disengage the detents 78.

Located in each of the generally cylindrical recesses 45, generally tangent to the adjacent through passageway 36 is a roller, generally designated 85, which may be fabricated of a frictional material, such as rubber, plastic, or the like, and molded or otherwise mounted on a shaft 86 having its lower and upper ends extending beyond the roller for rotative mounting in journal bearings 87 and 88 in respective openings or holes 50 and 71. Carried on the shaft 86, above the roller 85 and just below the top plate 65 is a worm wheel or gear 89. The roller 85 includes a roller proper 90 being of generally cylindrical configuration coaxially with the shaft 86 and having a frictional external surface of a diameter sufficient to engage slightly through the opening 48 into the adjacent passageway 36. However, the roller proper 90 is reduced in diameter throughout approximately 180° to define a reduced portion 91 of approximately semi-cylindrical configuration. The reduced portion 91 is of a diameter insufficient to extend into the passageway 36.

The roller proper 90 occupies a substantial portion of the roller 85, extending upwardly from the lower end thereof and terminates in a generally semi-circular or arcuate, upwardly facing ledge or shoulder 92. An upper generally cylindrical reduced portion 93 upstands from the upwardly facing ledge or shoulder 92, being coextensive with the ledge throughout approximately 180°, and extending therebeyond approximately an additional 90°, as at 94. The upper reduced portion 94 is generally flush and communicates with the first mentioned main or lower reduced portion 91. In addition, a generally sector shaped radially outstanding cylindrical portion 95 is of a radius generally equal to that of the roller proper 90, and is disposed generally coplanar with upper reduced portion 94.

That is, generally coplanar with the reduced portion 93, there extends a generally sector shaped holding portion 95, which may extend angularly approximately 90°, lying vertically over approximately one-half of the reduced portion 91, and specifically over the half portion 91 which terminates at one edge of the enlarged portion of roller proper 90. The sector shaped radially projecting quadrant-like holding portion 95 is also advantageously of frictional material, so that its outer arcuate surface provides a frictional engagement, as will appear presently.

The gear 89 is spaced over the holding portion 95, as by an intermediate portion 96.

An elongate shaft 100 is disposed in the upwardly facing groove 52 of body part 35, and extends entirely along the groove passing through the several recesses 51. Mounted on the shaft 100, in each recess 51 is a spiral gear or worm 101 in meshing engagement with an adjacent wheel or gear 89. The shaft 100 extends into the interior of motor housing 31 where it is provided with a gear or pinion 102. A motor 103 is mounted in the housing 31 and carries a drive gear 104 in driving engagement with pinion 102. Hence, the motor 103 effects simultaneous rotation through the shaft 100 of the several rollers 85.

Mounted in the body part 35, just inward of the motor housing 31, may be a motor switch 105. In use, the device 20 is placed in bridging relation across the container holder or box 21 with its opposite ends extending beyond opposite walls of the box. For example, as seen in FIG. 2, the body 30 extends across the box 21, with the under side of extension 72 resting on the upper edge of one end wall 24, and the other end wall 24 in supporting engagement with the under side of body 30 just inward of motor housing 31 for depressing engagement with motor switch 105. Thus, the device 20 cannot be electrically energized without being properly located in position across a vial container 21. Also, the motor 103 is of a type to stop in a single predetermined position, the motor stop position being such as to place all of the roller holding portions 95 extending into their respective adjacent passageways 36, as shown in the position of FIGS. 3 and 4.

In operation, say to cap a boxful of vials 28, the magazine is loaded with caps in each cylinder 80, the magazine being inverted to receive the caps, which are also inverted. The body 30 may be inverted and secured to the magazine 32 by the hereinbefore described snap interengagement therebetween. The loaded and assembled device 20 may then be turned over to its upright condition and placed in position over a row of containers 27, as shown in FIGS. 1 and 2. This condition is also shown in FIGS. 3 and 4, wherein a lowermost cap 110 drops gravitationally to rest on the upper surface of the holding portion 95 projecting into passageway 36. The next lowermost cap 111 rests on the lowermost cap 110, additional caps resting on each other within the associated chamber 80.

A vial 27 is shown in FIG. 3 with its externally threaded neck 112 extending upwardly into the passageway 36 to a position just below the under side of roller holding portion 95, as determined by limiting engagement of the vial shoulder 113 with the body shoulder 37.

Figure 4:
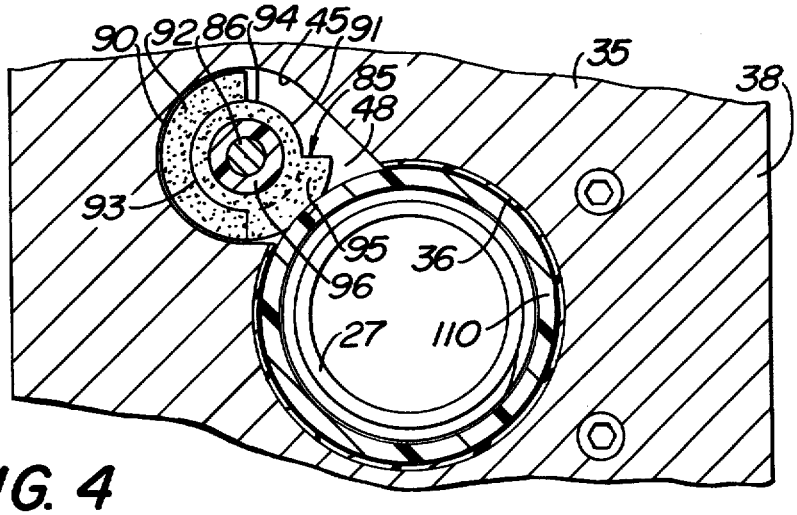
FIG. 4 is a sectional view taken generally along the line 4—4 of FIG. 3.

Upon energization of motor 103 to rotate the several rollers 85 counterclockwise, as seen in FIG. 4, the lowermost cap 110 will fall from the upper surface or top of holding portion 95, onto the shoulder or ledge 92, and thence upon movement of the upper reduced roller portion 94 into position facing the passageway 36, there is thereby afforded clearance for the lowermost cap 110 to fall onto the upper end of bottle neck 112. Continued roller rotation will cause the relatively enlarged or roller proper portion 90 to tangentially engage the lowermost cap 110 to rotate the latter on the relatively smooth internal surface of passageway 36 relative to the vial 27, which is held substantially fixed by frictional engagement with pad 63.

Figure 5:
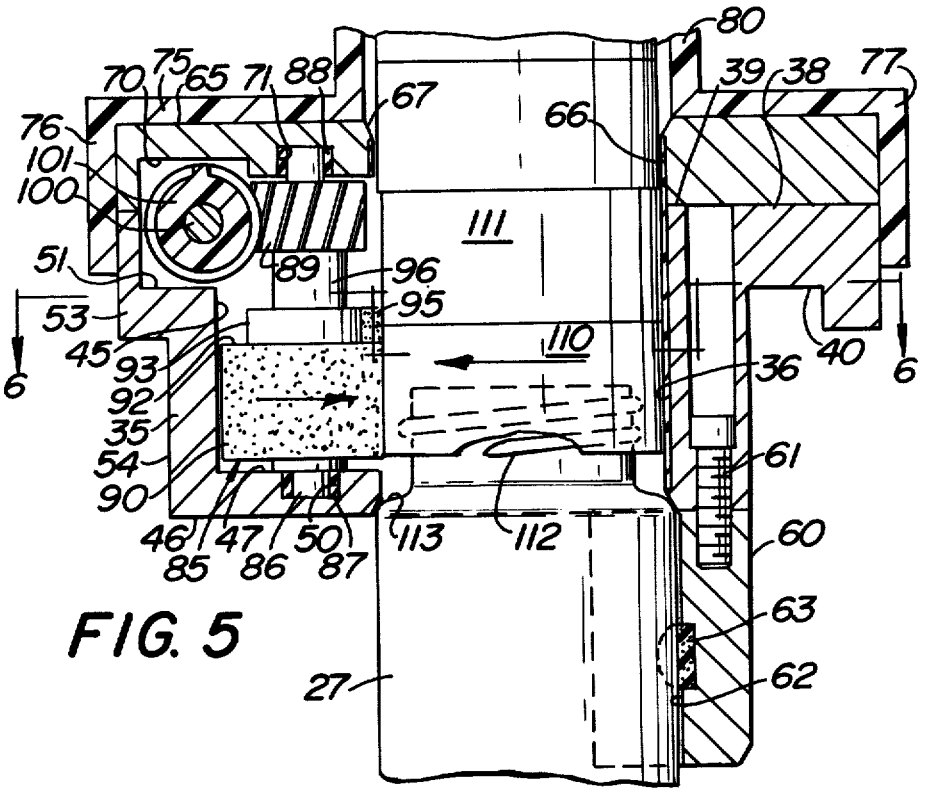
FIG. 5 is a sectional elevational view similar to FIG. 3, but illustrating an intermediate condition of the capping or cap applying operation.
Figure 6:
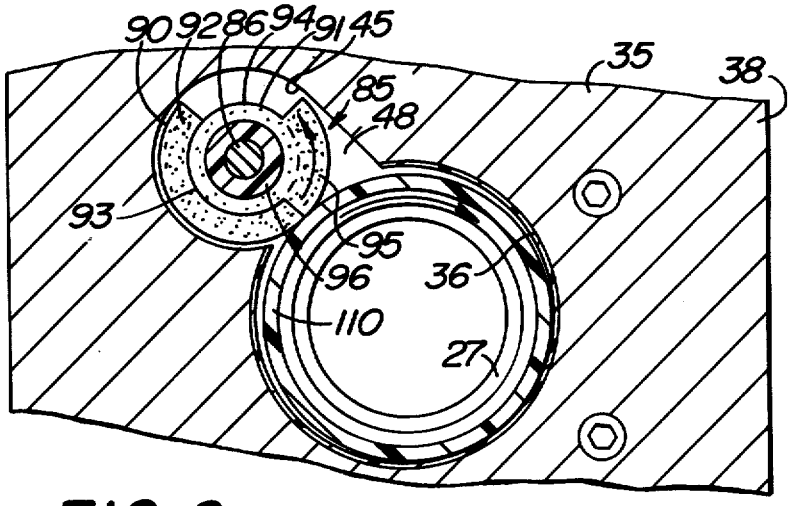
FIG. 6 is a horizontal sectional view taken generally along the line 6—6 of FIG. 5.

The intermediate condition of cap application is shown in FIG. 5, wherein the roller 85 has rotated at least slightly more than 360° to permit gravitational falling of the lowermost cap 110 onto the vial 27 and continued relative rotation of the cap with respect to the vial for threaded engagement therewith.

It will now therefore be understood that the reduced upper roller portion 94 may be considered as a cap discharge portion for passing the lowermost cap outwardly to a vial 27 to be applied thereto.

Figure 7:
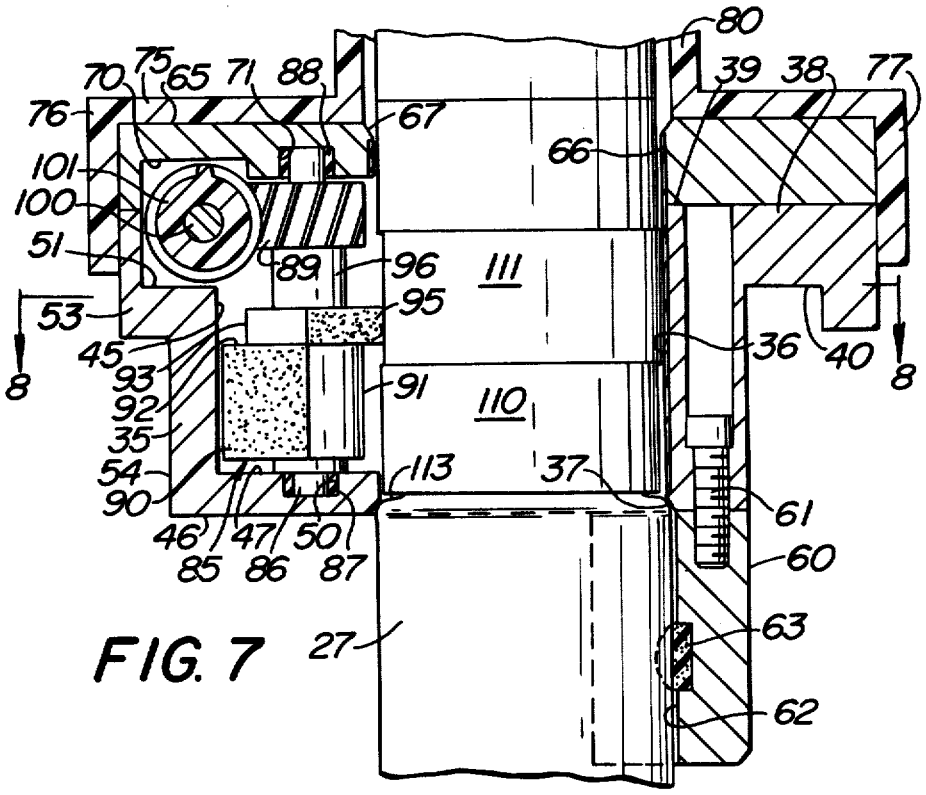
FIG. 7 is a sectional elevational view similar to FIGS. 5 and 3, but showing an almost completed capping operation.
Figure 8:
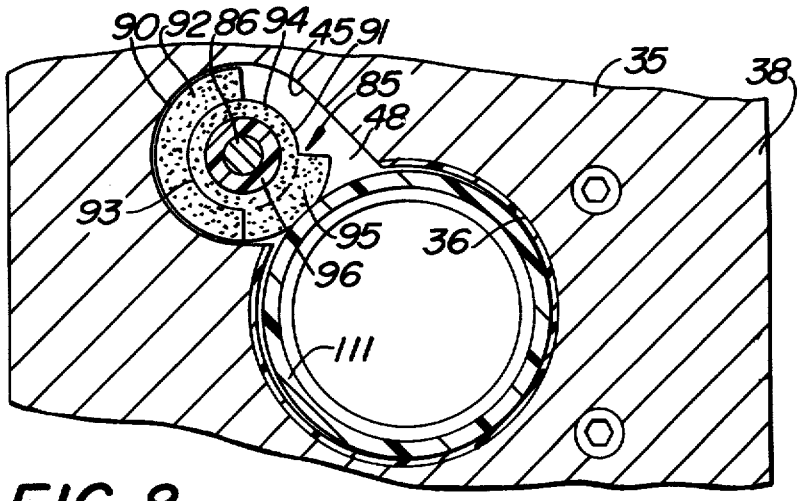
FIG. 8 is a horizontal sectional view taken generally along the line 8—8 of FIG. 7.

FIGS. 7 and 8 illustrate a further condition of cap application, wherein cap 110 has been fully applied to vial 27, the next upper adjacent cap 111 having fallen through reduced roller discharge region 94 to rest on the applied cap 110 in frictional engagement with the radially projecting holding portion 95. Of course, the above described procedure may be repeated for all of the vials 27. It is only necessary that the device 20 be raised from the first row and placed in position on the adjacent row of vials.

Figure 9:
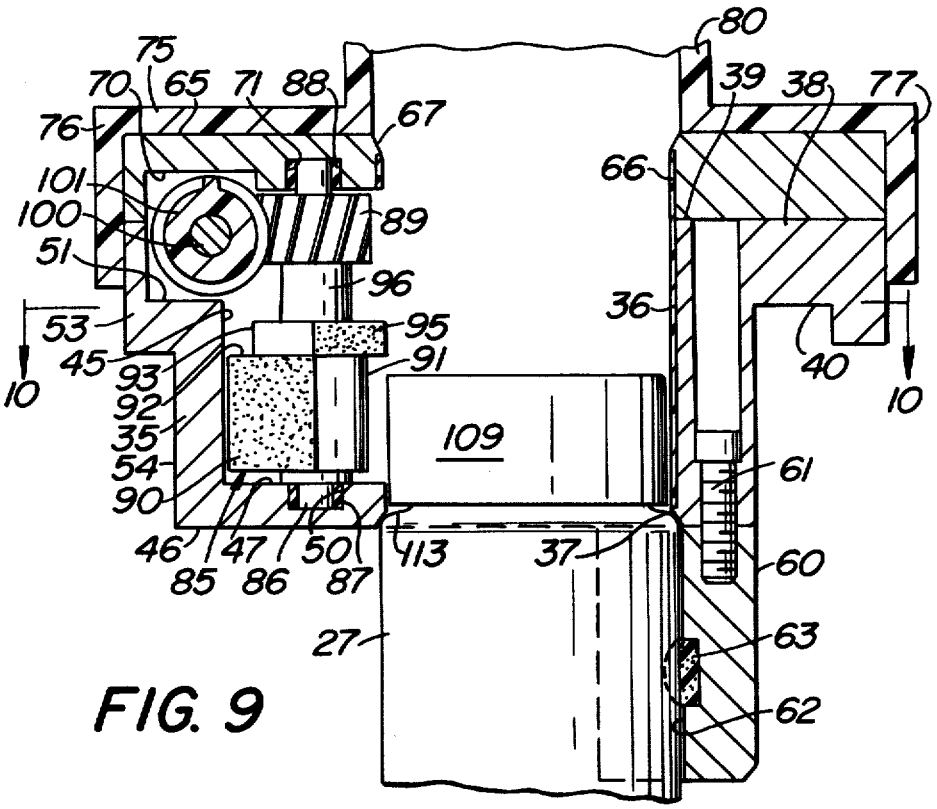
FIG. 9 is a sectional elevational view similar to FIGS. 3, 5 and 7, but illustrating an initial stage in an opening or uncapping operation.
Figure 10:
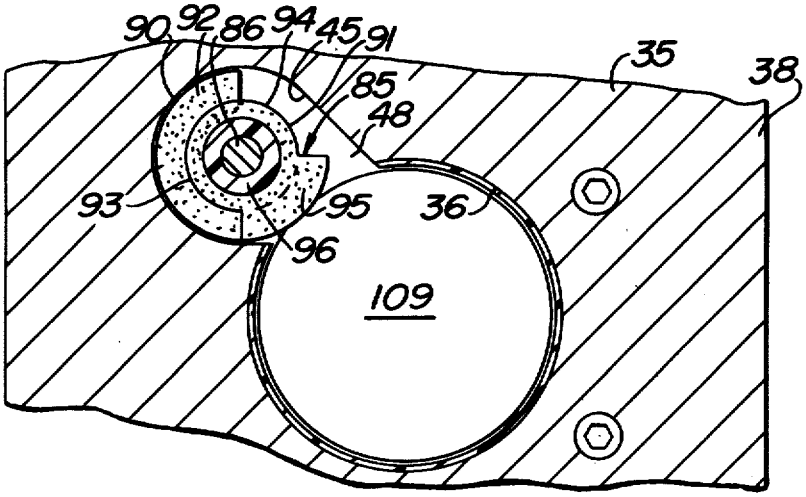
FIG. 10 is a horizontal sectional view taken generally along the line 10—10 of FIG. 9.
Figure 11:
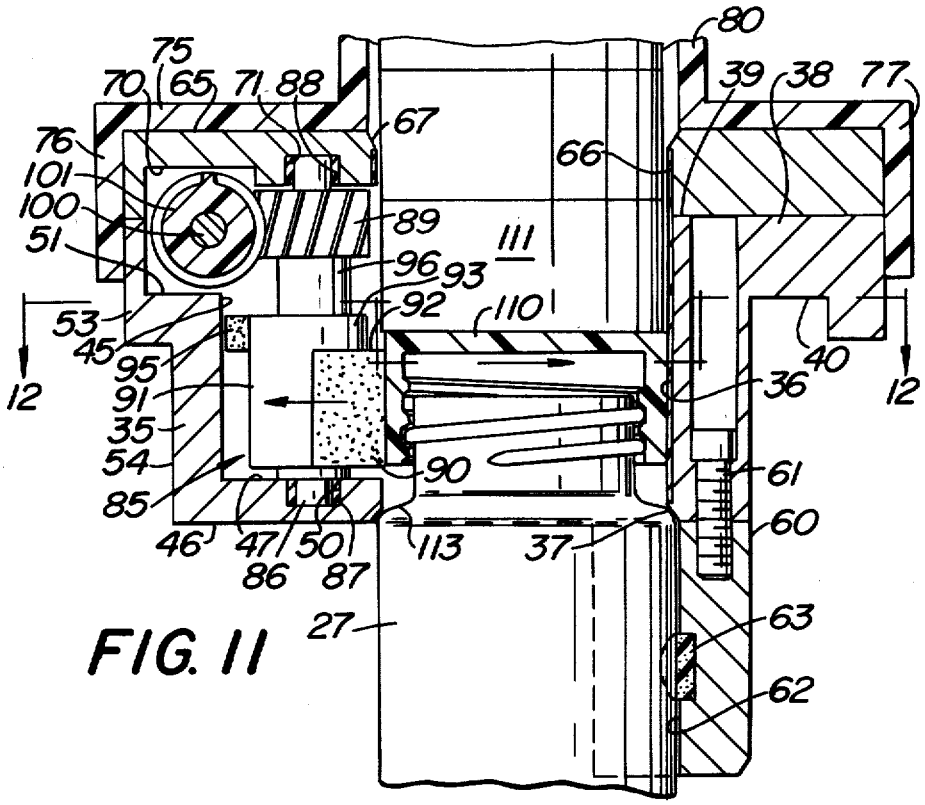
FIG. 11 is a sectional elevational view similar to FIG. 10, but illustrating a later condition in the cap removal operation.
Figure 12:
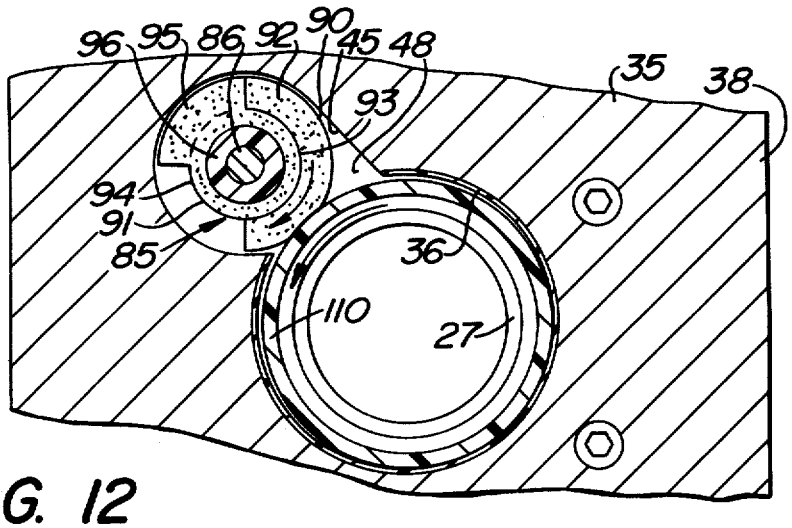
FIG. 12 is a sectional view taken generally along the line 12—12 of FIG. 11.

In the removal of threaded closures or caps from a vial, an initial condition is shown in FIGS. 9 and 10, wherein a vial 27 is in position within passageway 36, and a cap 109 is in position just below the radially projecting holding portion 95. Upon energization of the motor 103 in the direction to rotate roller 85 clockwise, as seen in FIG. 10, the relatively enlarged or proper roller portion 90 will rotate into frictional tangential engagement with cap 109 to remove the latter by unthreading rotation upwardly from its associated vial. This roller rotation may proceed until the cap 109 is entirely removed from its vial, whereupon stopping of the drive motor 103 will locate the roller holding portion 95 in holding engagement with the removed cap. The entire device 20 may then be displaced one row of vials for removing the caps of the next adjacent row of vials. In FIGS. 11 and 12 are shown a subsequent condition of cap removal, wherein a cap 113 is being removed in the same manner as described hereinbefore in connection with cap 109 and is simultaneously displacing the latter cap upwardly into the magazine. Of course, this procedure may be repeated until the magazine is full.

From the foregoing, it will be seen that the present invention provides a capping and uncapping device which is extremely simple while being highly automatic in operation, rapid and easy to use, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. Apparatus for closing or opening the threaded neck of containers, said apparatus comprising a body having an open ended generally cylindrical passageway for receiving through one end a container neck, and a roller rotatably mounted in said body generally proximate to and projecting radially into said passageway for rolling engagement with a closure in said passageway, said roller having a reduced region for receiving a closure during a limited angle of roller rotation and passing a closure into rolling relation with the roller upon continued roller rotation, said roller serving to frictionally rotate the passed closure to closed or open relation, respectively, upon oppositely directed rotation of the roller.

2. Apparatus according to claim 1, said reduced roller region having a closure discharge portion remote from and opening longitudinally of the roller in the direction away from said one end of said passageway for passing closures to be applied.

3. Apparatus according to claim 1, said reduced roller region having a closure entrance portion adjacent to and opening longitudinally of the roller in the direction toward said one passageway end for receiving an applied closure to be removed.

4. Apparatus according to claim 3, in combination with a closure magazine associated with said body opening into said passageway remote from said one end thereof, a radial holding portion on said roller adjacent to said magazine, and motive means to rotate said roller and constrained to stop roller rotation with said holding portion toward said passageway for radial holding engagement with a closure.

5. Apparatus according to claim 4, said reduced roller region having a closure discharge portion opening longitudinally of said roller toward and adjacent to said magazine for passing closures to be applied.

6. Apparatus according to claim 4, said holding portion extending across said entrance portion for location of the latter toward said passageway on roller stopping to receive an applied closure.

7. Apparatus according to claim 6, said reduced roller region being generally semi-cylindrical, and said holding portion being generally quadrant-like.

8. Apparatus according to claim 7, said holding portion being aligned longitudinally of said roller with a sector of said reduced region adjacent to one terminus thereof.

9. Apparatus according to claim 4, said body having an additional container neck receiving passageway arranged in a row with said first mentioned passageway, an additional closure magazine associated with said body and communicating therethrough with said additional passageway, an additional roller rotatably mounted in said body proximate to said additional passageway for rolling engagement with a closure in said additional passageway, said additional roller having an additional reduced region for receiving a closure during a limited angle of roller rotation and passing a closure into rolling relation with said additional roller upon continued roller rotation, said additional roller serving to frictionally rotate a passed closure to closed and opened relation, respectively, upon oppositely directed rotation of the additional roller, and drive means operatively connected in driving relation with said first mentioned and additional rollers for simultaneous rotation thereof.

10. Apparatus according to claim 9, said drive means comprising a drive shaft extending proximate to said first mentioned and additional rollers, and transmission means on said drive shaft at each of said first mentioned and additional rollers for rotating the latter upon rotation of said drive shaft.

11. Apparatus according to claim 1, in combination with stop means in said passageway for limiting engagement with a container to properly position a container neck in the passageway.

12. Apparatus according to claim 1, in combination with holding means in said passageway for holding a container against rotation upon rotation of a closure relative to the container.

13. Apparatus according to claim 12, said holding means comprising a frictional member located in said passageway generally opposite to said roller for bearing frictional engagement with a container having its cap engaged by said roller.

* * * * *